US011208180B1

(12) United States Patent
Ruffa

(10) Patent No.: US 11,208,180 B1
(45) Date of Patent: Dec. 28, 2021

(54) MAGNETIC MOTION COMPENSATION SYSTEM

(71) Applicant: The United States of America as represented by the Secretary of the Navy, Newport, RI (US)

(72) Inventor: Anthony A Ruffa, Hope Valley, RI (US)

(73) Assignee: The United States of America as represented by the Secretary of the Navy

( * ) Notice: Subject to any disclaimer, the term of this patent is extended or adjusted under 35 U.S.C. 154(b) by 24 days.

(21) Appl. No.: 16/928,041

(22) Filed: Jul. 14, 2020

(51) Int. Cl.
*B63B 39/00* (2006.01)
*B63B 21/56* (2006.01)
*B66D 1/00* (2006.01)

(52) U.S. Cl.
CPC ..... *B63B 39/00* (2013.01); *B63B 21/56* (2013.01); *B66D 1/00* (2013.01)

(58) Field of Classification Search
CPC ..... B63B 35/00; B63B 35/44; B63B 39/00; B63B 21/56; B66D 1/00; B66D 1/50; B66D 1/52; B66D 1/26; E21B 19/00; E21B 19/002; E21B 19/006
USPC ..... 114/253
See application file for complete search history.

(56) References Cited

U.S. PATENT DOCUMENTS 7,934,561 B2 * 5/2011 Ormond ..... E21B 19/006 166/355
8,754,649 B2 * 6/2014 Sudow ..... G01R 33/025 324/334
9,702,428 B2 * 7/2017 Cannell ..... E21B 19/002
10,279,447 B2 * 5/2019 Lowth ..... F16F 6/00

FOREIGN PATENT DOCUMENTS

CN 104555769 B * 7/2017 ..... B66D 1/00

* cited by examiner

*Primary Examiner* — Lars A Olson
(74) *Attorney, Agent, or Firm* — James M. Kasischke; Michael P. Stanley

(57) ABSTRACT

A system is provided to compensate for heave of a vessel in which the compensation system has a first panel with a first magnetic field having magnetic flux disposed in a first direction and a second panel parallel to the first panel. The second panel has a second magnetic field having magnetic flux disposed in a second direction with the first magnetic field parallel to the second magnetic field. A conducting loop is located between the first panel and the second panel. The conducting loop is attachable to a cable connected to a load suspended in water. Compensating force generated by the first magnetic field and the second magnetic field transfers to the cable to compensate for heaving motion of the vessel and stabilize the cable-connected load in the water.

15 Claims, 6 Drawing Sheets

MAGNETIC MOTION COMPENSATION SYSTEM

STATEMENT OF GOVERNMENT INTEREST

The invention described herein was made in the performance of official duties by employees of the U.S. Department of the Navy and may be manufactured, used, or licensed by or for the U.S. Government for any governmental purpose without payment of any royalties thereon.

CROSS REFERENCE TO OTHER PATENT APPLICATIONS

None.

BACKGROUND OF THE INVENTION

1) Field of the Invention

The present invention is directed to a system that compensates heave motion and employs magnetic fields to avoid an overload of a tow cable and an attached load.

2) Description of the Prior Art

Motion compensation systems monitor and react to vessel motion to avoid overload of a cable connected to an object in the water. These systems assist in reducing the load on the cable due to a heaving vessel.

The motions of a vessel in a seaway make overboard launching and recovery and underwater operations more difficult.

The principal cause of these motions is the vertical motion of the vessel, known as heave. These difficulties increase with higher sea states.

When a heavy body is towed from a surface vessel in high sea states, the cable can lose tension when the vessel heaves downward. Snap loads can then occur when the vessel heaves upward and the cable suddenly becomes taut. Conventional motion compensation systems mitigate snap loads, but such systems have technical problems and tend to be large and expensive. It is thus desirable to have an efficient and less expensive alternative for mitigating snap loads.

SUMMARY OF THE INVENTION

It is a primary object and general purpose of the present invention to use magnetic fields and Lenz's law to generate an electro-motive force that opposes and mitigates heave motion of a moving tow cable.

In accordance with the invention, a motion compensation system comprises a cable and a pair of panels. The panels are a first panel on a first side of the cable and a second panel on a second side of the cable. Each panel has a magnetic field. A conducting loop is attached to the cable such that the loop is between the first panel and the second panel.

According to an exemplary system herein, the system includes a cable-suspended load handling system and the motion compensation system. The handling system is mounted on a vessel and includes a cable attached to a load in the water. The motion compensation system is operationally attached to the load handling system.

The motion compensation system has a pair of panels including a first panel locatable on a first side of the cable and a second panel locatable on a second side of the cable. Each panel has a magnetic field. The motion compensation system also includes a conducting loop attached to the cable. The conducting loop is located between the first panel and the second panel. The force of the motion compensation system is transferred to the cable to compensate for heaving motion and to stabilize the load or the object.

Another embodiment of the system has a first panel with a first magnetic field having magnetic flux disposed in a first direction and a second panel parallel to the first panel and spaced apart from the first panel. The second panel has a second magnetic field having magnetic flux disposed in a second direction.

The first magnetic field is parallel to the second magnetic field. A conducting loop is located between the first panel and the second panel. The conducting loop can be attached to a cable connected to a load suspended in water. Compensating force generated by the first magnetic field and the second magnetic field is transferred to the cable to compensate for heaving motion of the vessel and to stabilize the load.

The present invention represents a more efficient and less costly alternative to mitigate snap loads. The inventive alternative can also be used with conventional motion compensation systems to reduce their size and complexity.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

The motion of a ship can put an extreme burden on a load handling system. This burden may exceed the capability of the mounts, fixtures, and cables in the load handling system.

Figure 1:
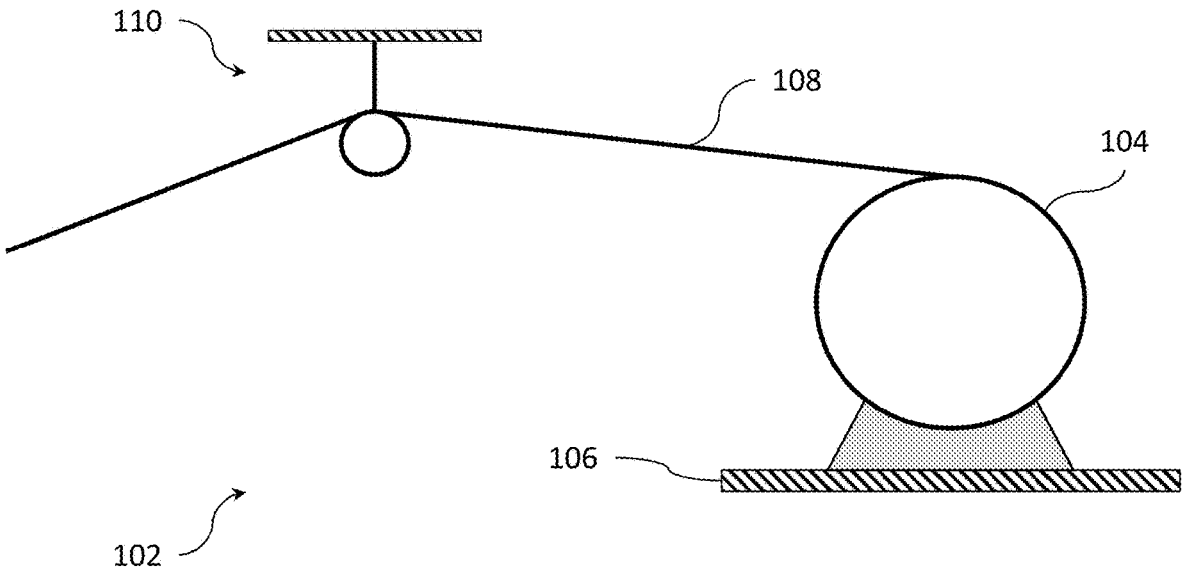
FIG. 1 illustrates a towing system with a tow cable under tension.

FIG. 1 depicts a cable-suspended load handling system 100. The handling system 100 includes a winch 104 mounted on a vessel 200. A cable 110 is deployed from the winch 104 through a sheave 114. The cable 110 of the cable-suspended load handling system 100 is in a taut state.

Figure 2:
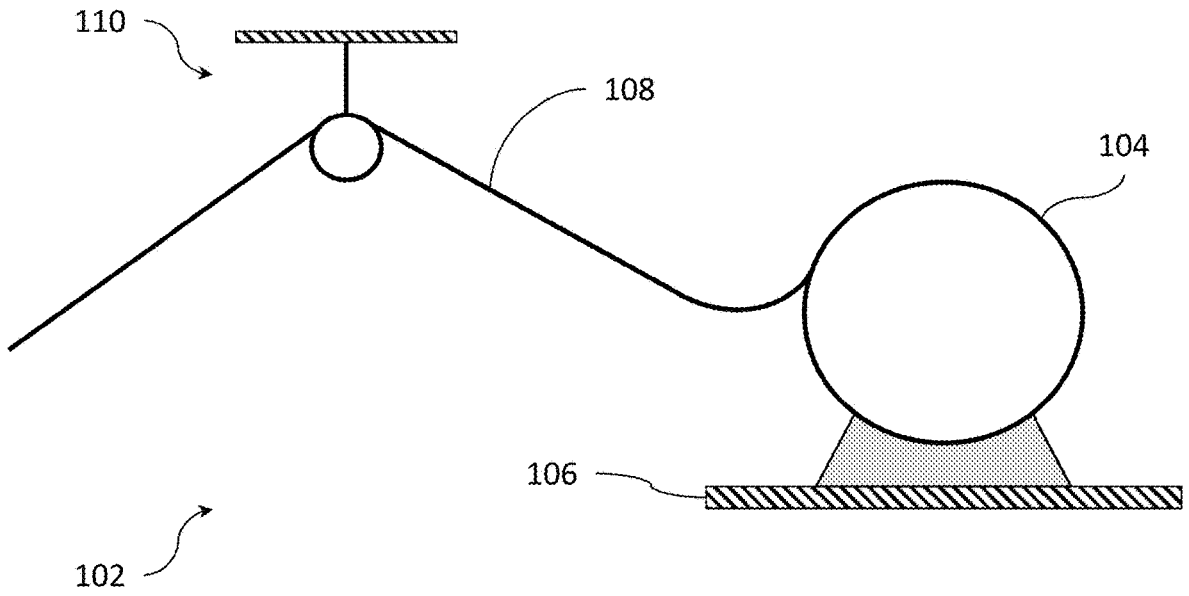
FIG. 2 illustrates the towing system with the tow cable under a slack condition.

FIG. 2 shows the cable 110 in a slack state after the vessel 200 heaves downward. When the vessel 200 heaves upward again, the cable 110 rapidly transitions back to a taut state, which causes a tension surge.

Embodiments disclosed herein use Lenz's law to provide heave motion compensation for a cable mounted system. Lenz's law states that a current will be induced in a conductor in the direction that opposes a change in the circuit or the magnetic field that produces it. When a conducting loop moves relative to a magnetic field, it produces an induced current that opposes the relative motion.

Figure 3:
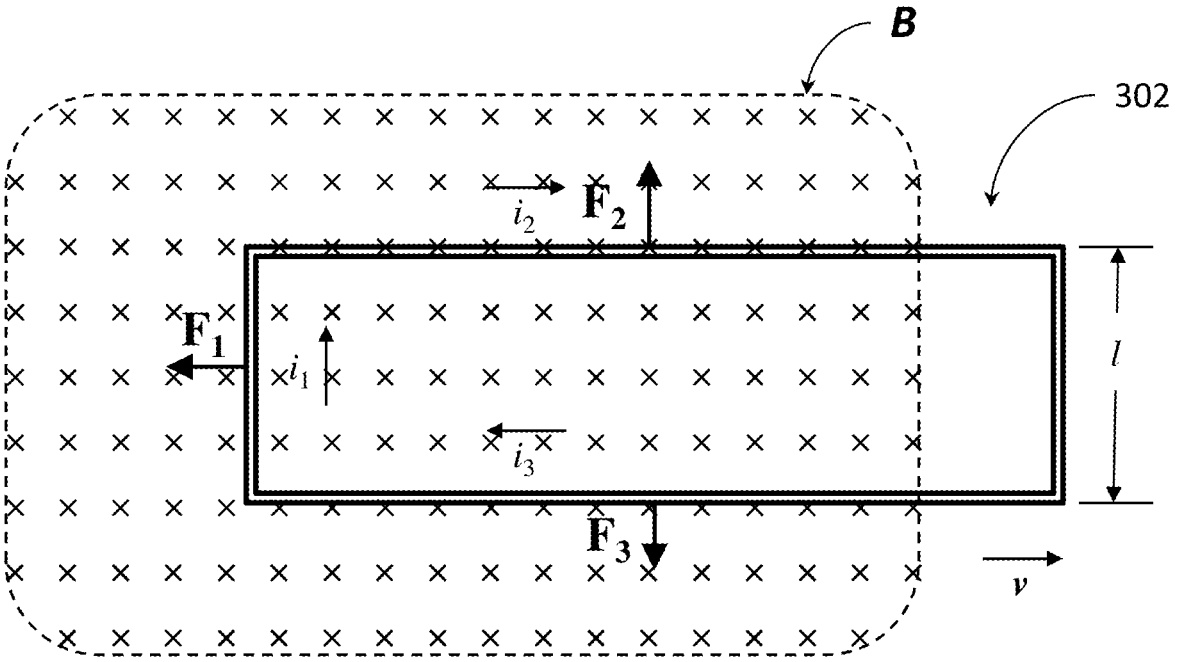
FIG. 3 illustrates a conducting loop in a magnetic field as part of the motion compensation system of the present invention.

FIG. 3 depicts a uniform magnetic field B and a conducting loop 300. The uniform magnetic field B is perpendicular to the plane containing the loop 300 and at least a portion of the loop is in the magnetic field. As shown in the figure, the loop 300 is rectangular with a width l and is in motion at a constant speed v.

When the loop 300 moves relative to the magnetic field B, a current i is induced in the loop that generates a force that opposes the motion. The magnitude of the force that opposes the motion is proportional to the speed v.

As the loop 300 moves, the portion of the flux (DB of the magnetic field B inside the loop is calculated in Equation (1)

$$\Phi_B = Blx, \tag{1}$$

where x is the instantaneous length from the left edge of the loop to the right edge of the magnetic field B in FIG. 3. Using Equation (2); the electromagnetic field ε is $$\varepsilon = -\frac{d\Phi_B}{dt} = Blv \tag{2}$$

in which v is the speed that the loop 300 is pulled through the magnetic field.

The current in the loop given by Equation (3)

$$i = \frac{\varepsilon}{R} = \frac{Blv}{R}, \tag{3}$$

where R is the resistance of the loop. Each conductive leg of the loop 300 (e.g., conductors 302, 304, 306) carries the same current (i.e., $i_1=i_2=i_3=i$). The current i in the loop 300 creates forces $F_1$, $F_2$, and $F_3$ that respectively act on the conductors 302, 304, 306, by Equation (4)

$$F = il \times B. \tag{4}$$

The forces $F_2$ and $F_3$ cancel, and the direction of $F_1$ is opposite that of the velocity v of the loop 300. For $F_1$, the magnitude of the vector l in Equation (4) is the width l and its direction is aligned with that of the induced current it shown in FIG. 3. The magnitude of the force $F_1$ is provided by Equation (5)

$$F_1 = \frac{B^2 l^2 v}{R}. \tag{5}$$

Figure 4:
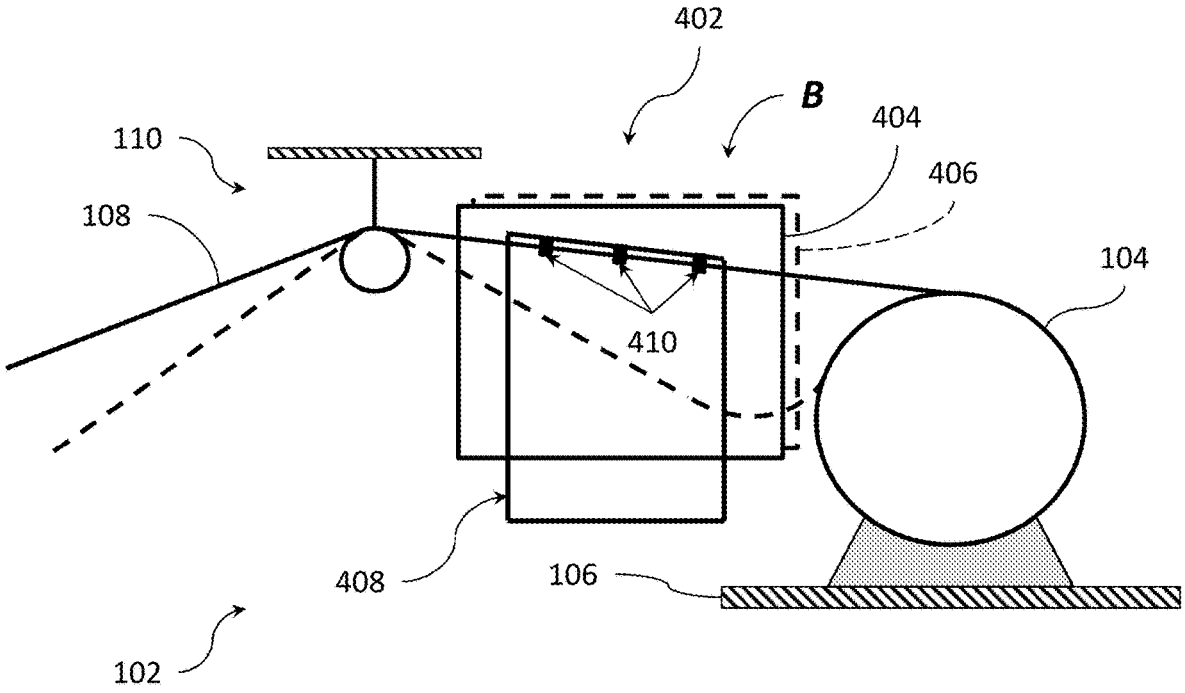
FIG. 4 illustrates a towing system with the motion compensation system of the present invention.

Referring now to FIG. 4, a motion compensation system 400 is shown. The compensation system 400 comprises a set of panels. A first panel 402 has a first magnetic field with magnetic flux disposed in a first direction. The second panel 404 is parallel to the first panel 402 and is spaced apart from the first panel. The second panel 404 has a second magnetic field with magnetic flux disposed in a second direction. The first magnetic field is parallel to the second magnetic field.

The cable 110 is located between the first panel 402 and the second panel 404. A conducting loop 406 is attached to the cable 110 by clamps 408 between the first panel 402 and the second panel 404. The 406 loop is a rectangular shape.

The first magnetic field and the second magnetic field are formed by a plurality of magnets (either permanent magnets or electromagnets) mounted on the first panel 402 and the second panel 404 in order to approximate a uniform magnetic field strength.

When an object is towed from a surface vessel, the cable 110 can lose tension as the vessel heaves downward. Snap loads can then occur when the vessel heaves upward again and the cable 110 suddenly becomes taut. The cable 110 transitioning from a slack state (shown as a dashed line in FIG. 4) to a taut state (shown as a solid line in the figure) will experience an opposing force that can be approximated by the loop moving through a uniform magnetic field, as described above.

Figure 5:
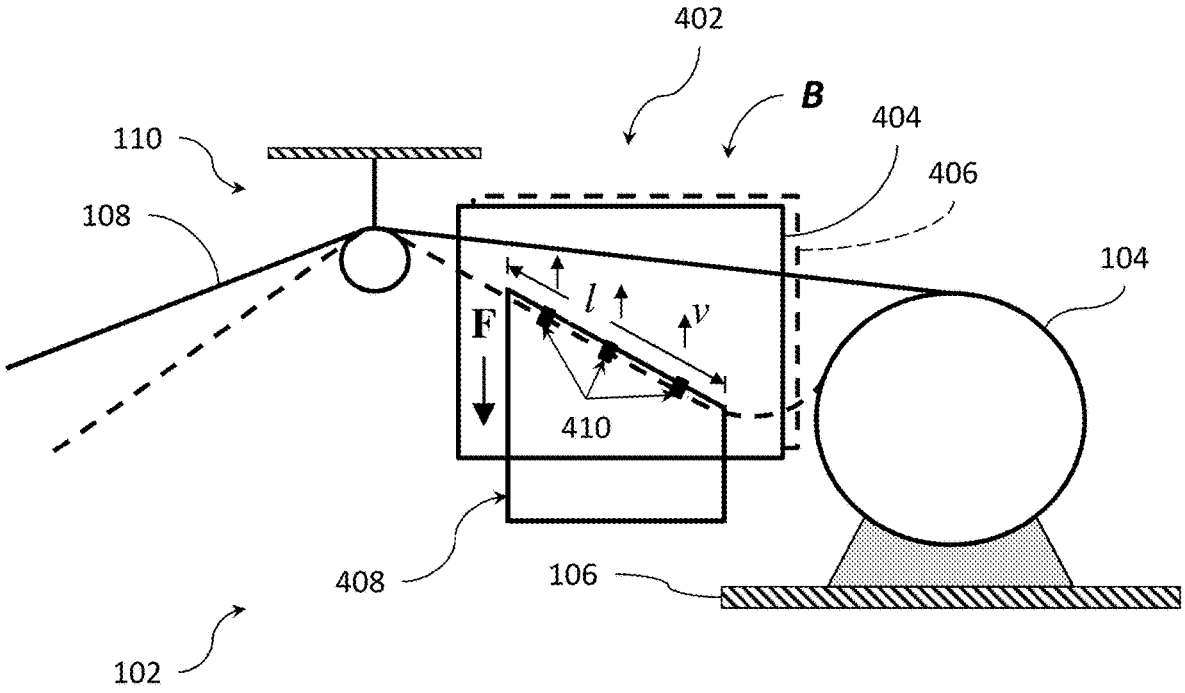
FIG. 5 illustrates operation of the motion compensation system.

FIG. 5 illustrates forces acting on the cable 110. When the cable 110 rapidly transitions from a slack state to a taut state, the upward velocity "V" of the cable causes part of the conducting loop 406 to move rapidly through the magnetic field B between the first panel 402 and the second panel 404. The movement of the conducting loop 406 through the magnetic fields induces a significant back electromagnetic force that opposes the upward motion of the cable 110.

The force F that opposes the movement of the cable 110 is $F=B^2l^2v/R$, where B is the magnetic field strength, l is the cable width within the magnetic field, v is the velocity of the cable, and R is the resistance in the conducting loop 406. The opposing force F can be estimated for the snap load problem with the following parameters: l=10 m, v=50 m/s, B=0.1 T, and R=0.006Ω. This leads to an opposing force F=8333N=1873 lb, which would effectively suppress the snap load.

The resistance R can be approximated for a conducting loop 406 having a total length of one hundred feet with the conducting loop comprising ten AWG 8 wires clamped to the cable 110. The resistance for one of the wires in the conducting loop 406 is R=0.06Ω, and the resistance of ten wires in parallel is R=0.006Ω.

In some embodiments, superconducting magnets can be used in the first panel 402 and the second panel 404. A portable cryogenic system maintains the required temperature so that a superconducting loop can be used as the conducting loop 406. Such cryogenic systems reduce the weight relative to degaussing systems (that make use of copper coils) by as much as 80% with the use of a long flexible cryostat that uses gaseous helium. When such a cryogenic system is deployed on a vessel, the motion compensation system 400 can leverage existing cryogenic system to significantly reduce weight with superconducting coils for electromagnets in the first panel 402 and the second panel 404.

For a conducting loop comprising a superconductor, $R \to 0$, so that $F \to \infty$, indicating that the previous analysis is not valid for a superconducting loop and needs to be modified as taught by R. H. Romer (European Journal of Physics 11(2), 103, 1990); hereby incorporated by reference. A superconducting loop subjected to a constant applied force F leads to the velocity: $v=Fl/(wB)^2 \sin \omega_0 t$, where $\omega_0=wB/\sqrt{ml}$ and $l=\propto\mu_0 w$, where $\propto=O(1)$. If m=20 kg (the weight of that section of cable) and $l=10^{-5}$ H, then $\omega_0=70.71$ rad/s, f=11.25 Hz, and $v=10^{-5}F \sin \omega_0 t$, (only an oscillatory motion is allowed for the superconducting version of the conducting loop 406).

This effectively suppresses snap loads, since the cable velocity must maintain a harmonic (sinusoidal) time dependence during a low-tension state, precluding any velocity having an impulsive time dependence that is characteristic of tension surges. The cable velocity must also maintain a harmonic time dependence during a high-tension state. A non-harmonic time dependence for the cable velocity would require an infinite force and is thus impossible.

Figure 6:
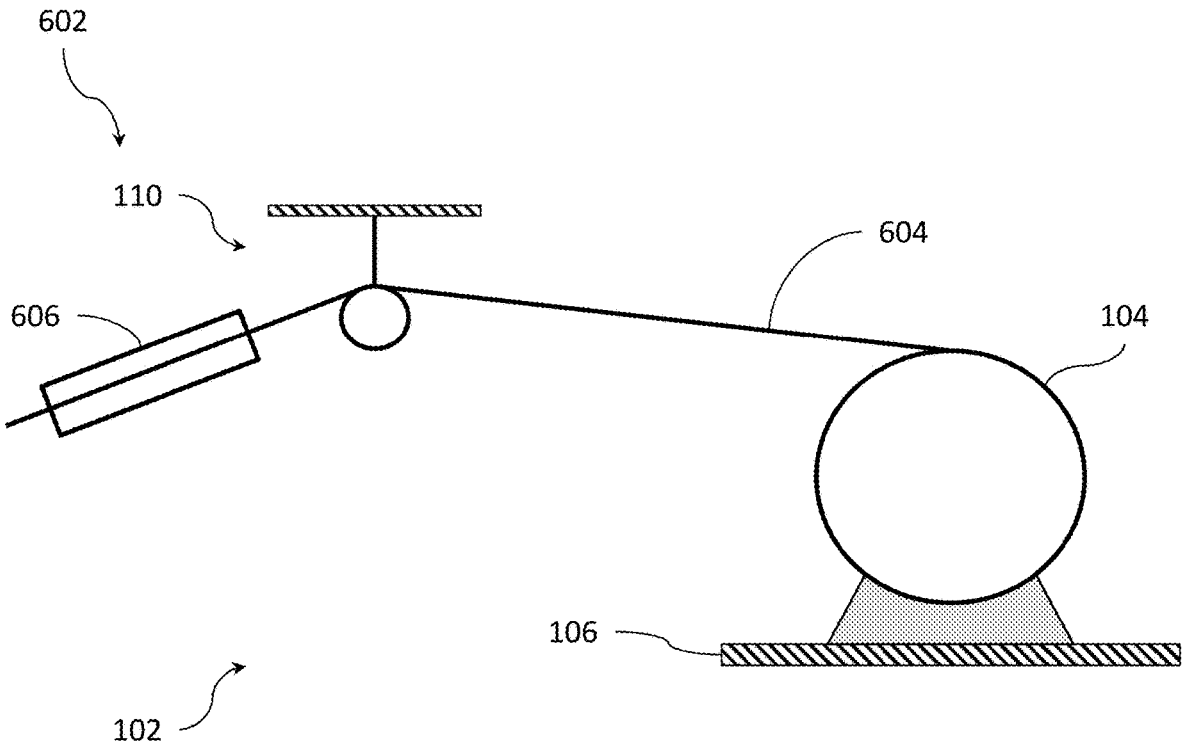
FIG. 6 illustrates a towing system having a variant motion compensation system.

Referring to FIG. 6, a motion compensation system 600 in another embodiment includes a magnetic tow cable 602 disposed in a conducting sleeve 604. The conducting sleeve 604 can be made from braided copper wire or other appropriate material. The rapid velocity of the magnetic tow cable 602 moving through the conducting sleeve 604 during a snap load event can dissipate a significant amount of kinetic energy via eddy currents generated in the conducting sleeve.

The opposing force F for this case is taught by G. Donoso et al. (European Journal of Physics 30, 855-869, 2009), and is specified by Equation (6)

$$F = \frac{15}{64}\pi^2\sigma v\mu^2\left(\frac{1}{a^3} - \frac{1}{b^3}\right). \tag{6}$$

Here a and b are the inner and outer conductor radii of the conducting sleeve 604, respectively, $\sigma=5.92\times10^7\Omega^{-1}\ m^{-1}$ (the electrical conductivity of copper) and $\mu=4.7\times10^{-8}\ T\cdot m^3$ (i.e., the magnitude of the magnetic dipole moment of a 3.2 mm long cylindrical, rare earth (SmCo) magnet having a 12.5 mm diameter). Note that this formula specifies the opposing force F for a single such magnet moving through the conducting sleeve 604. The opposing force for the magnetic tow cable 602 moving through a 300 meter length of such a conducting sleeve 604 can be estimated by summing the effect of 100,000 of such magnets, leading to an opposing force of $F=5\times10^6$ N.

The magnetic tow cable 602 does not have to be a permanent magnet. A copper wire coil built into the tow cable 602 in a helix pattern can support a magnetic field to produce a similar opposing force. Furthermore, since the duty cycles for active sonar systems are typically small (e.g., 10%); the unused part of the duty cycle could generate a magnetic field with the existing copper conductors. This would have the advantage of not requiring additional conductors, which would otherwise increase the cable diameter.

The invention has been described with references to specific embodiments. While particular values, relationships, materials, and steps have been set forth for purposes of describing concepts of the present disclosure; it will be appreciated by persons skilled in the art that numerous variations and/or modifications may be made to the invention as shown in the disclosed embodiments without departing from the spirit or scope of the basic concepts and operating principles of the invention as broadly described.

What is claimed is:

1. A system for heave compensation of a tow cable of a vessel, said system comprising:

a pair of panels having a first panel locatable on a first side of the tow cable and a second panel locatable on a second side of the tow cable, wherein each of said first panel and said second panel comprises a magnetic field; and a conducting loop capable of being attached to the tow cable with said conducting loop positioned between said first panel and said second panel;

wherein motion compensating forces are transferred to the cable at said attached conducting loop to compensate for heaving motion of the vessel.

2. The system of claim 1, wherein said first panel is parallel to said second panel.

3. The system of claim 2, wherein said first panel and said second panel are superconducting magnets.

4. The system of claim 2, wherein said conducting loop comprises a superconductor.

5. The system of claim 2, wherein said conducting loop has a rectangular shape.

6. The system of claim 5, said system further comprising a cable-suspended load handling system with said load handling system mountable on the vessel and attachable to a load object.

7. A system for heave compensation of a vessel, said system comprising:

a cable-suspended load handling system capable of being mounted to the vessel with said load handling system including a tow cable attachable to a suspended load;

a motion compensation system operationally attached to said cable-suspended load handling system with said motion compensation system having a magnetic field and an electrical conductor wherein relative motion between said electrical conductor and the magnetic field creates a compensating force and wherein the compensating force can be transferred to said tow cable to compensate for heaving motion of the vessel and to stabilize the load on said cable-suspended load handling system; and a first panel locatable on a first side of said tow cable and a second panel locatable on a second side of said tow cable wherein each of said first panel and said second panel comprises a magnetic field and a conducting loop attachable to said tow cable with said conducting loop between said first panel and said second panel.

8. The system of claim 7, wherein said first panel and said second panel comprise superconducting magnets.

9. The system of claim 8, wherein said conducting loop comprises a superconductor.

10. A system for heave compensation of a vessel, said system comprising:

a cable-suspended load handling system capable of being mounted to the vessel with said load handling system including a tow cable attachable to a suspended load; and a motion compensation system operationally attached to said cable-suspended load handling system with said motion compensation system having a magnetic field and an electrical conductor wherein relative motion between said electrical conductor and the magnetic field creates a compensating force and wherein the compensating force can be transferred to said tow cable to compensate for heaving motion of the vessel and to stabilize the load on said cable-suspended load handling system;

wherein said tow cable is a magnetized cable and said motion compensation system comprises a conductive sleeve surrounding said magnetized cable.

11. The system of claim 10, wherein said tow cable comprises a wire coil built into the tow cable to support a magnetic field.

12. A system for heave compensation of a vessel, said system comprising:

a cable-suspended load handling system capable of being mounted to the vessel with said load handling system including a tow cable attachable to a suspended load;

a motion compensation system operationally attached to said cable-suspended load handling system with said motion compensation system having a magnetic field and an electrical conductor wherein relative motion between said electrical conductor and the magnetic field creates a compensating force and wherein the compensating force can be transferred to said tow cable to compensate for heaving motion of the vessel and to stabilize the load on said cable-suspended load handling system; and a cryogenic system operationally connected to said motion compensation system.

13. A system for compensating for the heave of waves on a marine vessel, said system comprising:

a first panel with a first magnetic field having magnetic flux disposed in a first direction;

a second panel parallel to said first panel and spaced apart from said first panel, said second panel with a second magnetic field having magnetic flux disposed in a second direction, wherein the first magnetic field is parallel to the second magnetic field; and a conducting loop between said first panel and said second panel, said conducting loop attachable to a cable connected to a load suspended in water;

wherein compensating force generated by the first magnetic field and the second magnetic field is transferred to the cable to compensate for heaving motion of the vessel and stabilize the load in the water.

14. The system of claim 13, further comprising a cryogenic system connected to said first panel and said second panel.

15. The system of claim 13, further comprising a cryogenic system connected to said conducting loop.

* * * * *